US007481136B2

(12) United States Patent
Chiang

(10) Patent No.: US 7,481,136 B2
(45) Date of Patent: Jan. 27, 2009

(54) TOOL DEVICE FOR DRIVING VARIOUS TOOL MEMBERS

(75) Inventor: Wen Hung Chiang, Taichung Hsien (TW)

(73) Assignee: Hsin Ying Enterprise Co., Ltd., Wantien Tsuen, Dadu Hsian Taichung Hsien (TW)

( * ) Notice: Subject to any disclaimer, the term of this patent is extended or adjusted under 35 U.S.C. 154(b) by 0 days.

(21) Appl. No.: 11/789,249

(22) Filed: Apr. 24, 2007

(65) Prior Publication Data

US 2008/0264215 A1 Oct. 30, 2008

(51) Int. Cl.
*B25B 23/16* (2006.01)
*B25B 13/58* (2006.01)

(52) U.S. Cl. ..... 81/177.75; 81/184; 81/177.85

(58) Field of Classification Search ..... 81/177.75, 81/177.85, 451, 452, 124.5, 185, 184
See application file for complete search history.

(56) References Cited

U.S. PATENT DOCUMENTS 1,619,255 A * 3/1927 Haynes ..... 81/185
2,669,148 A * 2/1954 Falk ..... 81/124.1
6,105,473 A * 8/2000 Huang ..... 81/177.75
6,270,085 B1 8/2001 Chen et al.
6,637,755 B2 10/2003 Chen et al.
7,018,298 B1 * 3/2006 Chiou ..... 81/177.85

* cited by examiner

*Primary Examiner*—Hadi Shakeri
(74) *Attorney, Agent, or Firm*—Charles E. Baxley

(57) ABSTRACT

A tool device includes a shaft having a noncircular socket opening for slidably and tiltably receiving a three-dimensional engaging member of a tool member for allowing the tool member to be tilted relative to the shaft to different angular position, and the shaft includes an engaging hole for receiving a driven member, a control ferrule may retain the shaft in line with the tool member, and a sleeve includes a non-circular opening for engaging with another driven member, the sleeve is rotatable in concert with the shaft for allowing the driven members of different diameters or dimensions to be selectively rotated or driven by the shaft and the sleeve.

9 Claims, 10 Drawing Sheets

TOOL DEVICE FOR DRIVING VARIOUS TOOL MEMBERS

BACKGROUND OF THE INVENTION

1. Field of the Invention

The present invention relates to a tool device, and more particularly to a tool device including a sleeve slidably attached onto a shaft for receiving and for driving various tool members of different sizes or diameters or dimensions.

2. Description of the Prior Art

Typical tool devices comprise a tool shank or socket having an engaging hole formed in one end thereof for receiving a tool bit or tool member, and a retaining or anchoring device attached onto the tool shank or socket for detachably securing the tool bit or tool member to the tool shank or socket.

For example, U.S. Pat. No. 6,270,085 to Chen et al. discloses one of the typical chuck devices for tool bits and also comprising a tube having a longitudinal engaging hole formed in one end thereof for receiving a tool bit or tool member, and a retaining or chuck device attached onto the tube for detachably securing the tool bit or tool member to the tube.

However, the longitudinal engaging hole of the tube may be used for receiving a tool bit or tool member of a single size only, and the tube may not be separated or disengaged from the chuck device such that the typical chuck device and the tube may not be replaced or changed with each other and may be used for receiving the tool bit or tool member of a single size only.

U.S. Pat. No. 6,637,755 to Chen et al. discloses another typical chuck device for tool bits and also comprising a socket having a longitudinal engaging hole formed in one end thereof for receiving a tool bit or tool member, and a retaining or chuck device attached onto the tube for detachably securing the tool bit or tool member to the socket.

However, similarly, the longitudinal engaging hole of the socket may be used for receiving a tool bit or tool member of a single size only, and the socket may not be separated or disengaged from the chuck device such that the typical chuck device and the socket may not be replaced or changed with each other and may thus be used for receiving the tool bit or tool member of a single size only.

The present invention has arisen to mitigate and/or obviate the afore-described disadvantages of the conventional tool shanks or sockets or tool devices.

SUMMARY OF THE INVENTION

The primary objective of the present invention is to provide a tool device including a sleeve slidably attached onto a shaft for receiving and for driving various tool members of different sizes or diameters or dimensions.

In accordance with one aspect of the invention, there is provided a tool device comprising a tool member including a three-dimensional engaging member provided on a first end thereof and having at least one flat surface formed therein, a shaft including a first end having a non-circular socket opening formed therein and having at least one curved surface formed therein for pivotally receiving the engaging member of the tool member and for engaging with the at least one flat surface of the non-circular engaging member of the tool member and for allowing the tool member to be selectively tilted relative to a longitudinal axis of the shaft to different angular position, and the shaft including a second end having a non-circular engaging hole formed therein for receiving a first driven member, a control ferrule slidably engaged onto the shaft, and slidable and selectively engageable onto the tool member for retaining the longitudinal axis of the shaft in line with the tool member and for preventing the shaft from being tilted relative to the tool member to other angular position, and a sleeve slidably attached to the second end of the shaft, and including a non-circular opening provided in a first end portion of the sleeve for selectively engaging with a second driven member, the sleeve being rotatable in concert with the shaft for allowing the first and the second driven member to be selectively driven by the shaft and the sleeve.

The shaft includes a retaining ring engaged onto the shaft and engageable with the control ferrule for limiting the control ferrule to slide relative to the shaft. The control ferrule includes two limiting grooves formed therein for engaging with the retaining ring and for limiting the control ferrule to move relative to the shaft and for maintaining the control ferrule either in engagement with only the shaft or in engagement with both the shaft and the tool member.

The tool member includes a peripheral depression formed therein and arranged for allowing the shaft to be tilted relative to the tool member to different angular position. The shaft includes a retaining member disposed therein for selectively engaging with the engaging member of the tool member and for preventing the engaging member of the tool member from being disengaged from the shaft.

The shaft includes a magnetic member disposed therein for attracting the engaging member of the tool member to the shaft. The shaft includes a magnetic member disposed therein for attracting the first driven member to the shaft. The shaft includes a non-circular segment formed on an outer peripheral portion of the second end of the shaft for engaging with the non-circular opening of and the sleeve and for allowing the sleeve to be rotatable in concert with the shaft.

A spring member may further be provided and engaged between the shaft and the sleeve for biasing the sleeve relative to the shaft. The sleeve includes an inner peripheral depression formed therein for receiving the spring member. The sleeve includes a peripheral flange formed therein, and the shaft includes a retaining ring engaged onto the shaft and engageable with the peripheral flange of the sleeve for limiting the sleeve to slide relative to the shaft.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
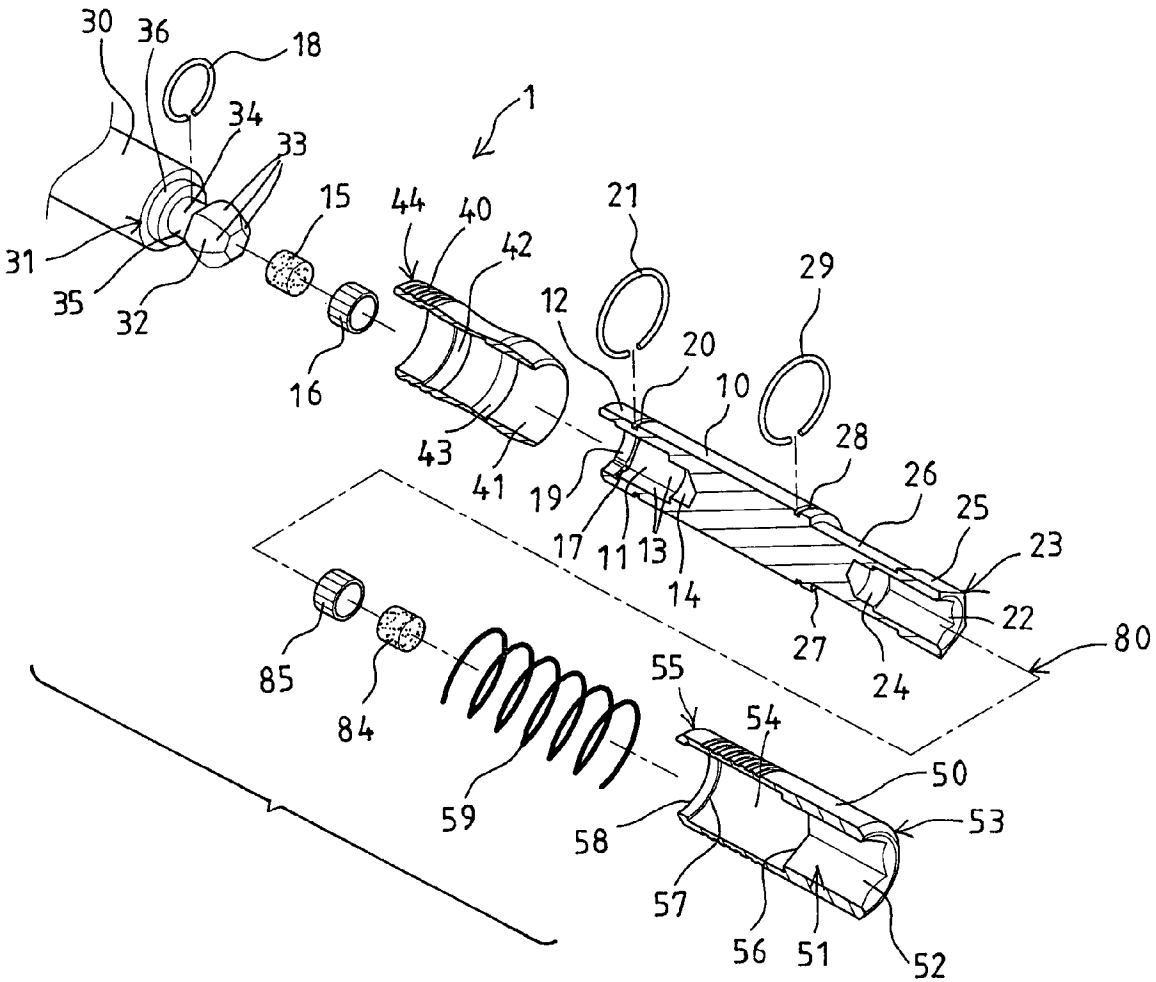
FIG. 1 is a partial exploded view of a tool device in accordance with the present invention.
Figure 2:
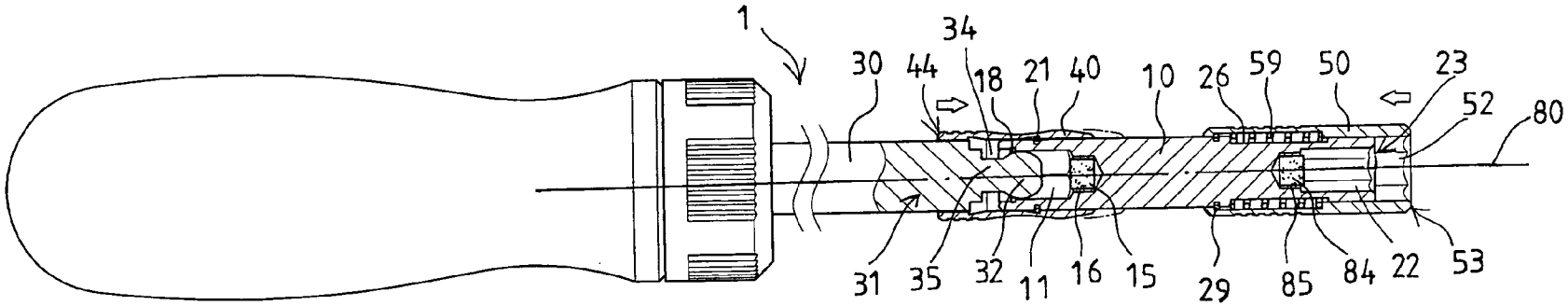
FIG. 2 is a plan schematic view of the tool device, in which a portion of the tool device has also been cut off for showing the inner structure of the tool device.
Figure 3:
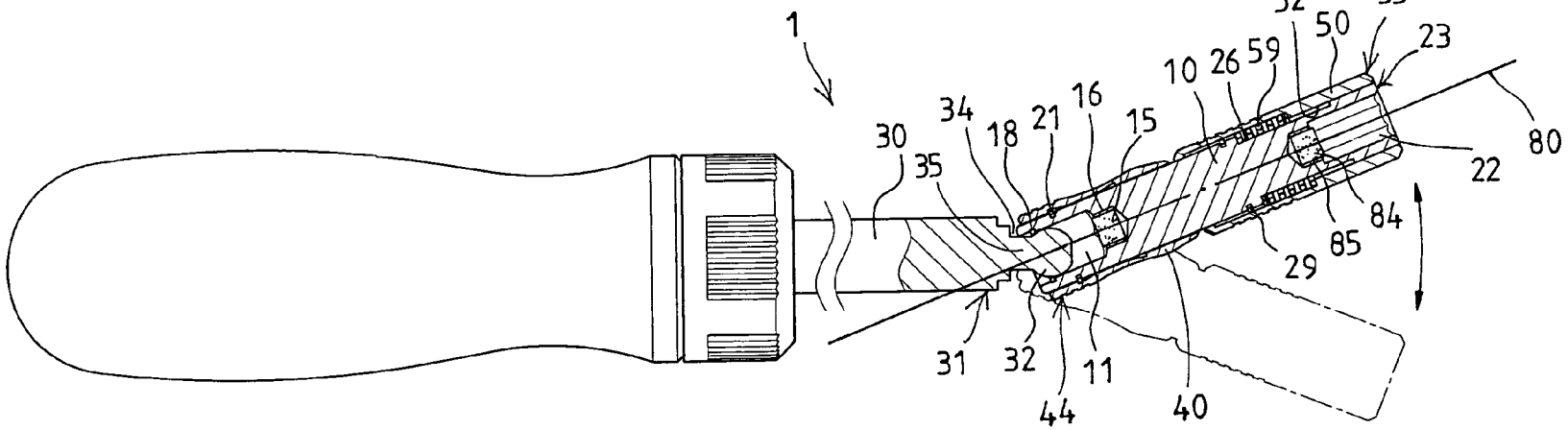
FIG. 3 is a plan schematic view similar to FIG. 2, illustrating the operation of the tool device.

Referring to the drawings, and initially to FIGS. 1-3, a tool device 1 in accordance with the present invention comprises a shaft 10 including a socket opening 11 provided or formed in one end 12 thereof, and the socket opening 11 of the shaft 10 includes a non-circular cross section, such as a hexagonal cross section having one or more flat surfaces 13 formed therein, for slidably and/or rotatably or pivotally and tiltably or slantably receiving a non-circular spatial or three-dimensional engaging member 32 that is formed or provided on one end 31 of a driving tool member 30. The engaging member 32 of the tool member 30 includes a non-circular cross section, such as a hexagonal cross section having one or more curved or flat surfaces 33 formed in outer peripheral portion thereof (FIG. 1) for engaging with the corresponding non-circular socket opening 11 and/or the corresponding flat surfaces 13 of the shaft 10.

As shown in FIGS. 2 and 3, due to the slidable and/or rotatable or pivotal engagement between the curved surfaces 33 of the tool member 30 and the flat surfaces 13 of the shaft 10, the shaft 10 is allowed to be tilted relative to the engaging member 32 of the tool member 30, or relatively, the engaging member 32 of the tool member 30 is allowed to be tilted relative to the longitudinal axis 80 of the shaft 10 to different angular position, and also to allow the shaft 10 to be rotated or driven by the engaging member 32 of the tool member 30 when the tool member 30 is rotated or driven by the users and by the engagement of the curved surfaces 33 of the tool member 30 and the flat surfaces 13 of the shaft 10. The shaft 10 may include a cavity 14 formed therein and communicating with the socket opening 11 of the shaft 10 for receiving a magnetic member 15 therein.

For solidly attaching or securing the magnetic member 15 to the shaft 10, the magnetic member 15 may first be engaged into a barrel 16, and the barrel 16 may include a rough or serrated outer peripheral surface formed on the outer peripheral portion thereof for frictionally or solidly engaging into the cavity 14 of the shaft 10 and for allowing the barrel 16 and thus the magnetic member 15 to be easily and quickly attached or secured to the shaft 10 by forcing the barrel 16 into the shaft 10 and with a force-fitted engagement. The magnetic member 15 may be used to act with or to attract the engaging member 32 of the tool member 30 toward the shaft 10 for preventing the shaft 10 from being disengaged or separated from the engaging member 32 of the tool member 30, and/or for further positioning or anchoring the engaging member 32 of the tool member 30 to the shaft 10.

The tool member 30 may include one or more spring-biased projections (not shown) attached thereto and partially extended out from either of the curved surfaces 33 thereof for engaging with either of the flat surfaces 13 of the shaft 10 and for further suitably positioning or anchoring the engaging member 32 of the tool member 30 to the shaft 10. The tool member 30 further includes a peripheral depression 34 formed therein, such as formed in the middle portion thereof and located between the engaging member 32 and the shaft 30 for forming a diameter reduced neck portion 35. The formation or the provision of the neck portion 35 and the peripheral depression 34 in the tool member 30 allows the tool member 30 to be suitably and selectively slanted or tilted relative to the longitudinal axis 80 of the shaft 10 to any selected or different angular position.

The shaft 10 includes a peripheral groove 17 formed in the inner peripheral portion thereof for receiving or engaging with a clamping or retaining member 18 therein, and the retaining member 18 is slidably engaged in the peripheral depression 34 of the tool member 30 and selectively engageable with the engaging member 32 of the tool member 30 (FIG. 3) for anchoring and securing the engaging member 32 of the tool member 30 to the shaft 10 and for preventing the engaging member 32 of the tool member 30 from being disengaged from the shaft 10. The tool member 30 further includes a peripheral shoulder or protrusion 36 formed thereon, such as arranged to have the peripheral depression 34 of the tool member 30 to be formed and located between the peripheral protrusion 36 and the engaging member 32 of the tool member 30. The shaft 10 includes an open end 19 for selectively engaging with or onto the peripheral protrusion 36 of the tool member 30 (FIG. 2), in order to stably or solidly anchor or secure the engaging member 32 of the tool member 30 to the shaft 10 and to prevent the tool member 30 from being slanted or tilted relative to the longitudinal axis 80 of the shaft 10.

The shaft 10 further includes a peripheral groove 20 formed in the outer peripheral portion thereof and in the one end 12 of the shaft 10 for receiving a retaining ring 21 therein which is partially extended out of the outer peripheral portion of the shaft 10. A sleeve or control ferrule 40 is slidably or rotatably attached or engaged onto the shaft 10 or includes a bore 41 formed therein for slidably receiving the shaft 10, and includes two peripheral and/or ratchet limiting grooves 42, 43 formed therein and located closer to one end 44 thereof and communicating with the bore 41 of the control ferrule 40 for receiving or engaging with the clamping or retaining ring 21 and for limiting the control ferrule 40 to move or to slide relative to the shaft 10 and also for preventing the control ferrule 40 from being disengaged from the shaft 10.

The shaft 10 further includes an engaging hole 22 formed in the other end 23 thereof, and the engaging hole 22 of the shaft 10 includes a non-circular cross section, such as a hexagonal cross section for receiving and for engaging with and for coupling to various driven members 81, 82, 83 therein, such as spark plugs (not shown), lock nuts or fasteners 81, 82 (FIGS. 4, 5) of different sizes or dimension or outer diameters, tool members or work pieces or drive bits 83 (FIG. 6), or the like. The driven members 81, 82, 83 may include a non-circular or hexagonal member or cross section provided thereon for engaging with the engaging hole 22 of the shaft 10 and for allowing the driven members 81-83 to be rotated or driven by the shaft 10. The shaft 10 may further include another magnetic member 84 engaged therein for attracting the driven members 81-83 to the shaft 10.

For solidly attaching or securing the magnetic member 84 to the shaft 10, the magnetic member 84 may first be engaged into a barrel 85, and the barrel 85 may include a rough or serrated outer peripheral surface formed on the outer peripheral portion thereof for frictionally or solidly engaging into a cavity 24 that is formed in the other end 23 of the shaft 10 and for allowing the barrel 85 and thus the magnetic member 84 to be easily and quickly attached or secured to the shaft 10 by forcing the barrel 85 into the shaft 10 and with a force-fitted engagement. The magnetic member 84 may be used to act with or to couple or attract the driven members 81-83 toward the shaft 10 for preventing the driven members 81-83 from being disengaged or separated from the shaft 10, and/or for further positioning or anchoring or securing the driven members 81-83 to the shaft 10.

The shaft 10 further includes a non-circular segment 25, such as a hexagonal segment 25 formed on the outer peripheral portion of the other end 23 of the shaft 10, and further includes a peripheral recess 26 formed in the outer peripheral portion of the middle portion of the shaft 10 and located beside the hexagonal segment 25 for forming an outer peripheral shoulder 27, and further includes an outer peripheral slot 28 formed in the outer peripheral portion of the middle portion of the shaft 10 for receiving a retaining ring 29 therein which is partially extended out of the outer peripheral portion of the shaft 10. A sleeve 50 is slidably attached or engaged onto the other end 23 of the shaft 10 or includes a bore 51 formed therein for slidably receiving or attaching onto the shaft 10, and includes a non-circular opening 52 provided or formed in one end portion thereof for selectively engaging with the driven members 81 (FIG. 4) and the hexagonal segment 25 of the shaft 10 and for allowing the sleeve 50 to be rotatable in concert with the shaft 10, and thus for allowing the driven members 81 and the sleeve 50 to be rotated or driven by the shaft 10 and the driving tool member 30.

The sleeve 50 further includes a peripheral depression 54 formed in the inner peripheral portion thereof and preferably located closer to the other end portion 55 thereof for forming or defining two inner peripheral shoulders 56, 57 and/or an outer peripheral flange 58 and for receiving a spring member 59, the spring member 59 may be engaged with the inner peripheral shoulder 56 of the sleeve 50 and the outer peripheral shoulder 27 of the shaft 10 for biasing the sleeve 50 to engage onto the other end 23 of the shaft 10 and/or to partially extend out of the other end 23 of the shaft 10 (FIG. 4), or for biasing the other end 23 of the shaft 10 to selectively engage into the non-circular opening 52 of the sleeve 50 and thus for allowing the driven members 81 to be engaged with the non-circular opening 52 of the sleeve 50. The other inner peripheral shoulder 57 or the outer peripheral flange 58 of the sleeve 50 may be selectively engaged with the retaining ring 29 (FIG. 4) for limiting the sleeve 50 to move or to slide relative to the shaft 10 and also for preventing the sleeve 50 from being disengaged from the shaft 10.

Figure 4:
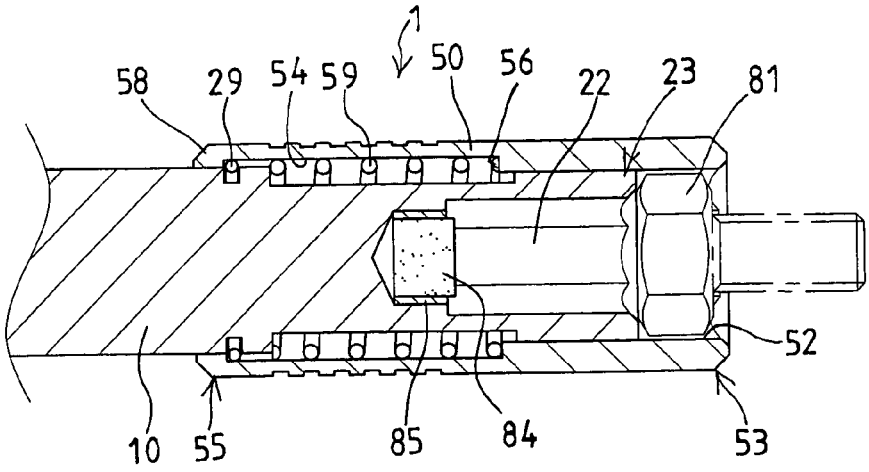
FIG. 4 is an enlarged partial cross sectional view illustrating the operation of the tool device.
Figure 5:
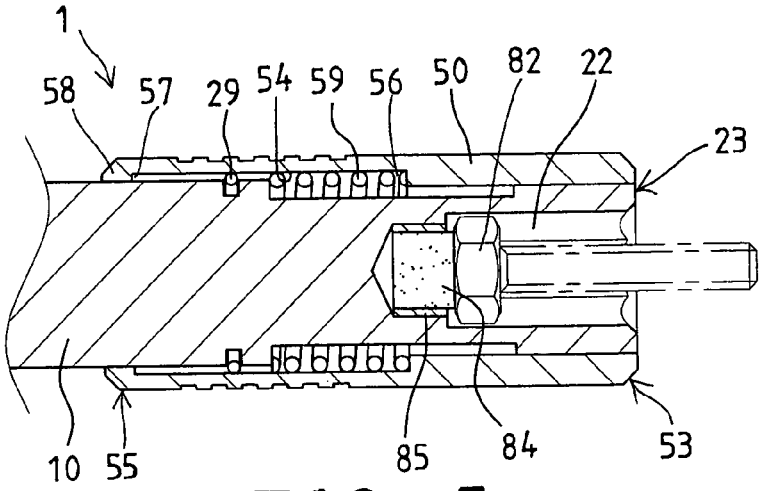
FIGS. 5, 6 are enlarged partial cross sectional views similar to FIG. 4, illustrating the operation of the tool device.
Figure 6:
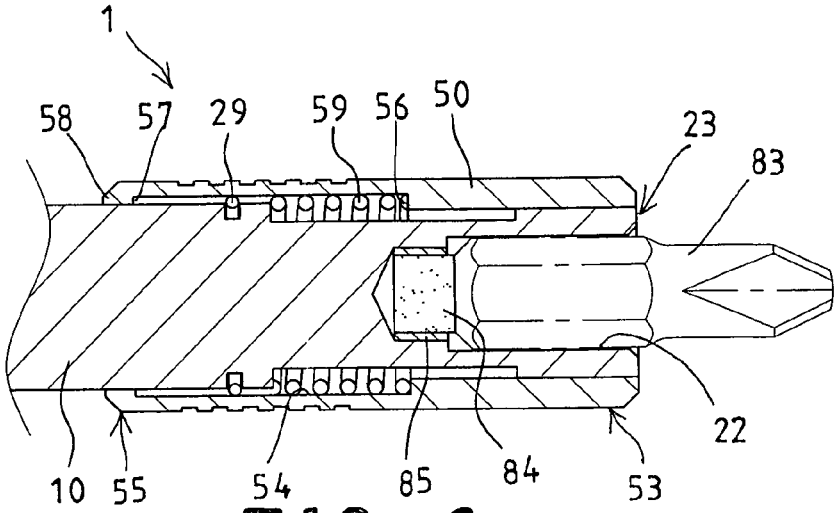

In operation, as shown in FIG. 3, the shaft 10 may be selectively tilted relative to the engaging member 32 of the tool member 30, or relatively, the engaging member 32 of the tool member 30 may be tilted relative to the longitudinal axis 80 of the shaft 10 to different angular position, to allow the shaft 10 to be rotated or driven by the engaging member 32 of the tool member 30 even when the shaft 10 is tilted relative to the tool member 30, and as shown in FIG. 2, the shaft 10 may also be solidly attached or engaged onto the tool member 30 and aligned with the tool member 30 with the control ferrule 40 for preventing the shaft 10 from being tilted relative to the tool member 30, and for allowing the shaft 10 to be effectively rotated or driven by the tool member 30. In addition or simultaneously, as shown in FIGS. 4-6, the driven members 81, 82, 83 of different sizes or dimension or outer diameters may be selectively engaged with the engaging hole 22 of the shaft 10 (FIGS. 5, 6) or engaged with the non-circular opening 52 of the sleeve 50 for allowing the driven members 81-83 to be selectively rotated or driven by the shaft 10 and the driving tool member 30 with the sleeve 50.

Figure 7:
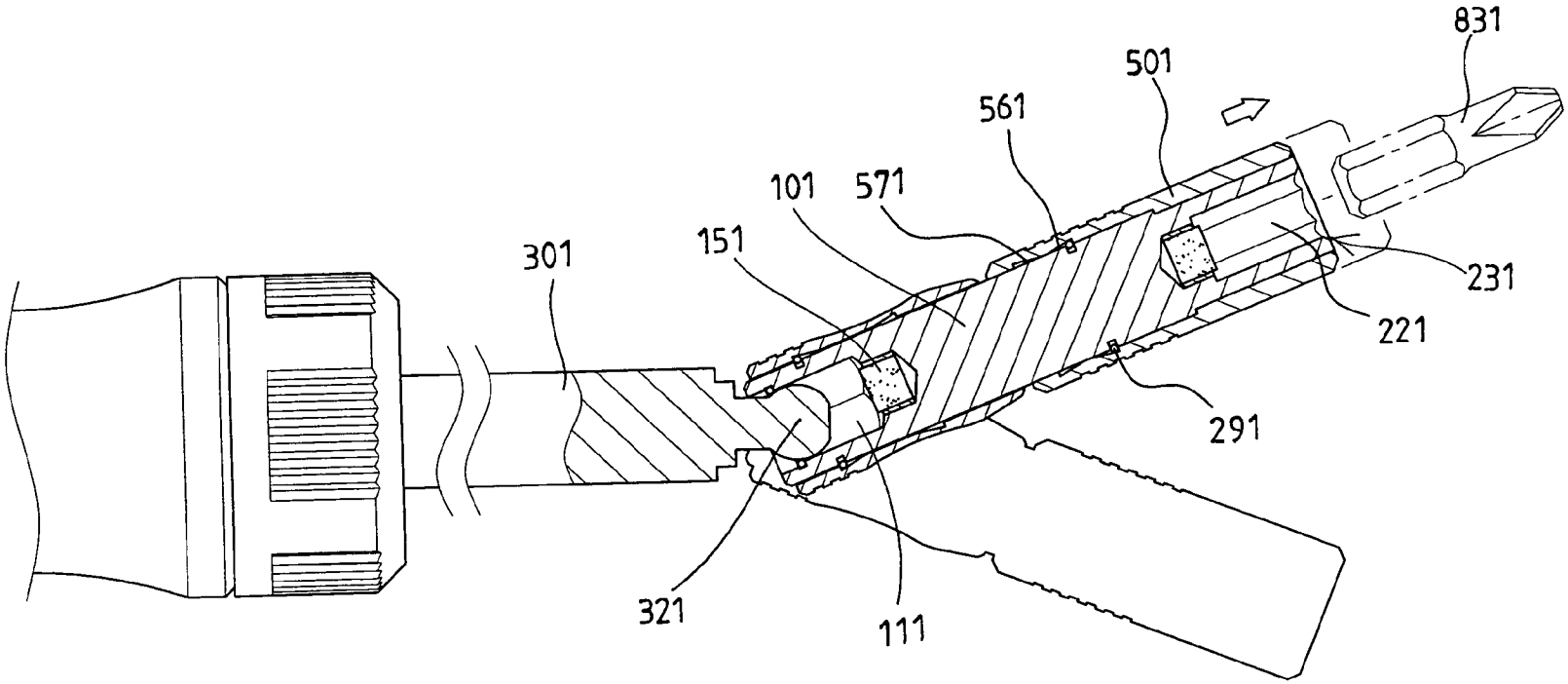
FIG. 7 is a plan schematic view similar to FIGS. 2 and 3, illustrating the other arrangement of the tool device.

Alternatively, as shown in FIG. 7, the driving tool member 301 may also include a rounded or spherical or engaging member 321 slidably and/or rotatably or pivotally and tiltably or slantably received in the socket opening 111 of the shaft 101, and includes a magnetic member 151 engaged into the shaft 101 for attracting the engaging member 321 of the tool member 301 toward the shaft 101, the shaft 101 may also includes an engaging hole 221 formed in the other end 231 thereof for receiving and for engaging with various driven members 831, and includes a retaining ring 291 engaged onto the shaft 101 and partially extended out of the outer peripheral portion of the shaft 101, and a sleeve 501 slidably attached or engaged onto the other end 231 of the shaft 101 or includes two peripheral and/or ratchet limiting grooves 561, 571 formed therein for engaging with the retaining ring 291 and for limiting the sleeve 501 to move or to slide relative to the shaft 101 and also for preventing the sleeve 501 from being disengaged from the shaft 101.

Figure 8:
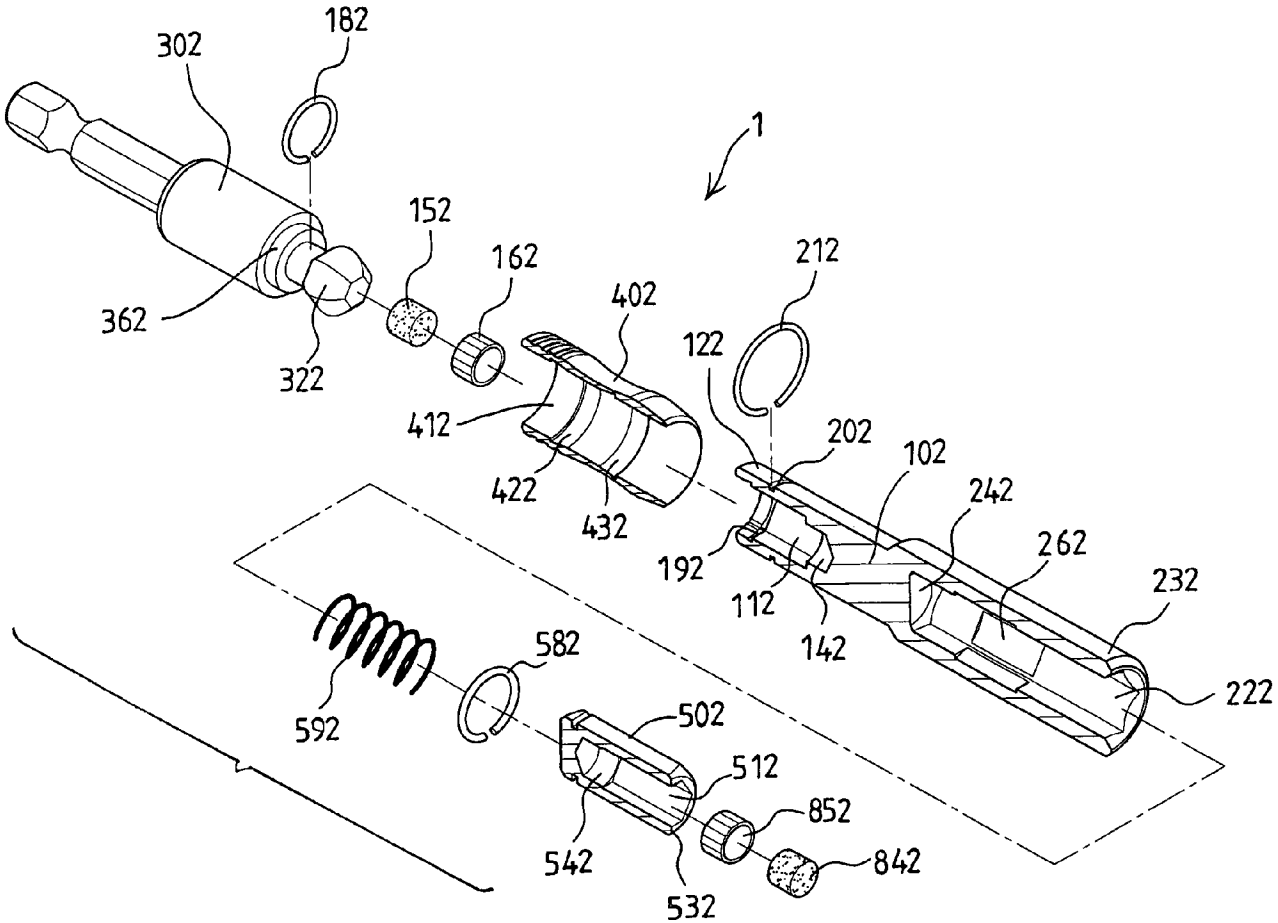
FIG. 8 is an exploded view similar to FIG. 1, illustrating the further arrangement of the tool device.
Figure 9:
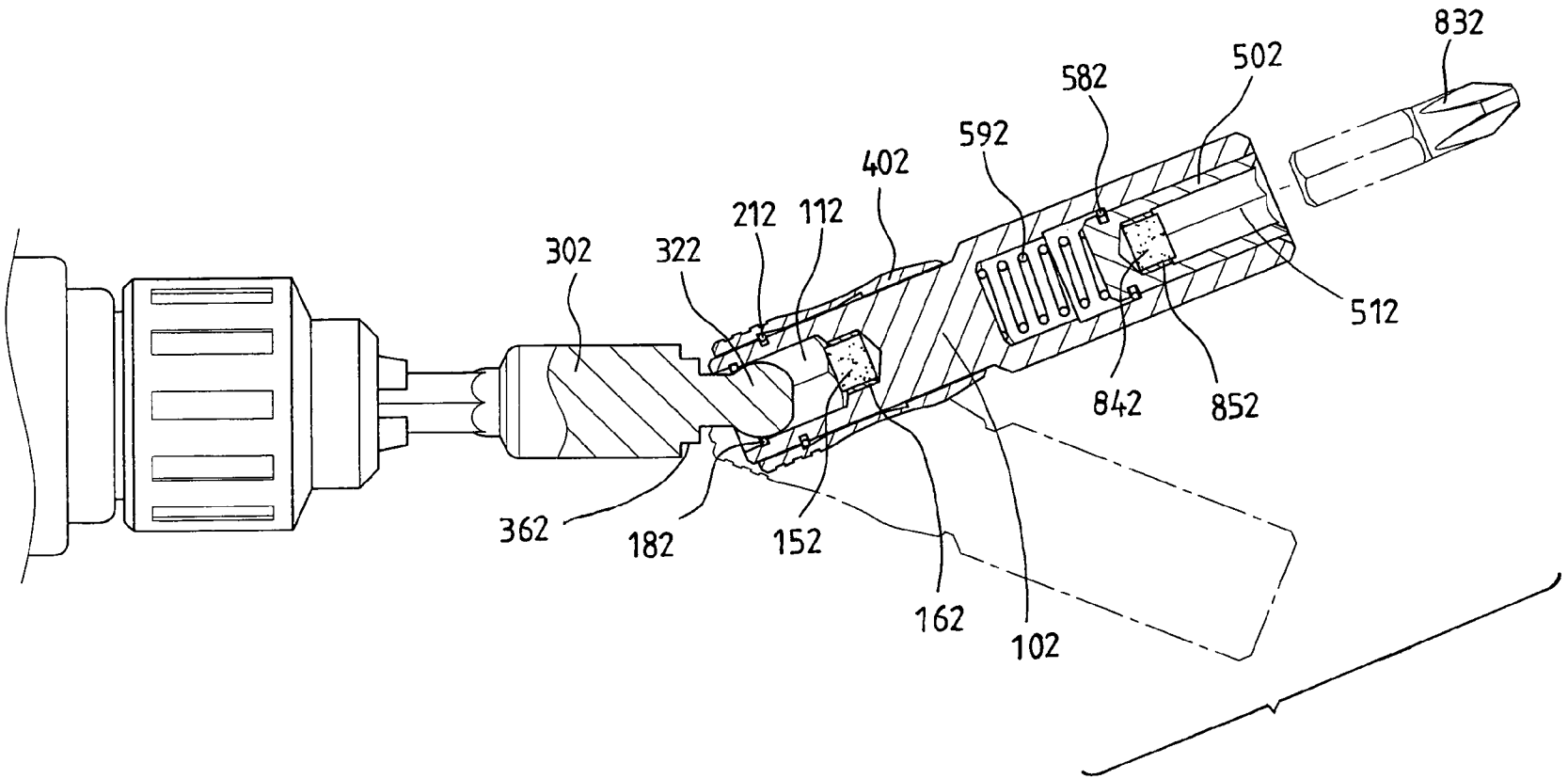
FIG. 9 is a plan schematic view of the tool device as shown in FIG. 8, in which a portion of the tool device has been cut off for showing an inner structure of the tool device and for illustrating the operation of the tool device as shown in FIG. 8.
Figure 10:
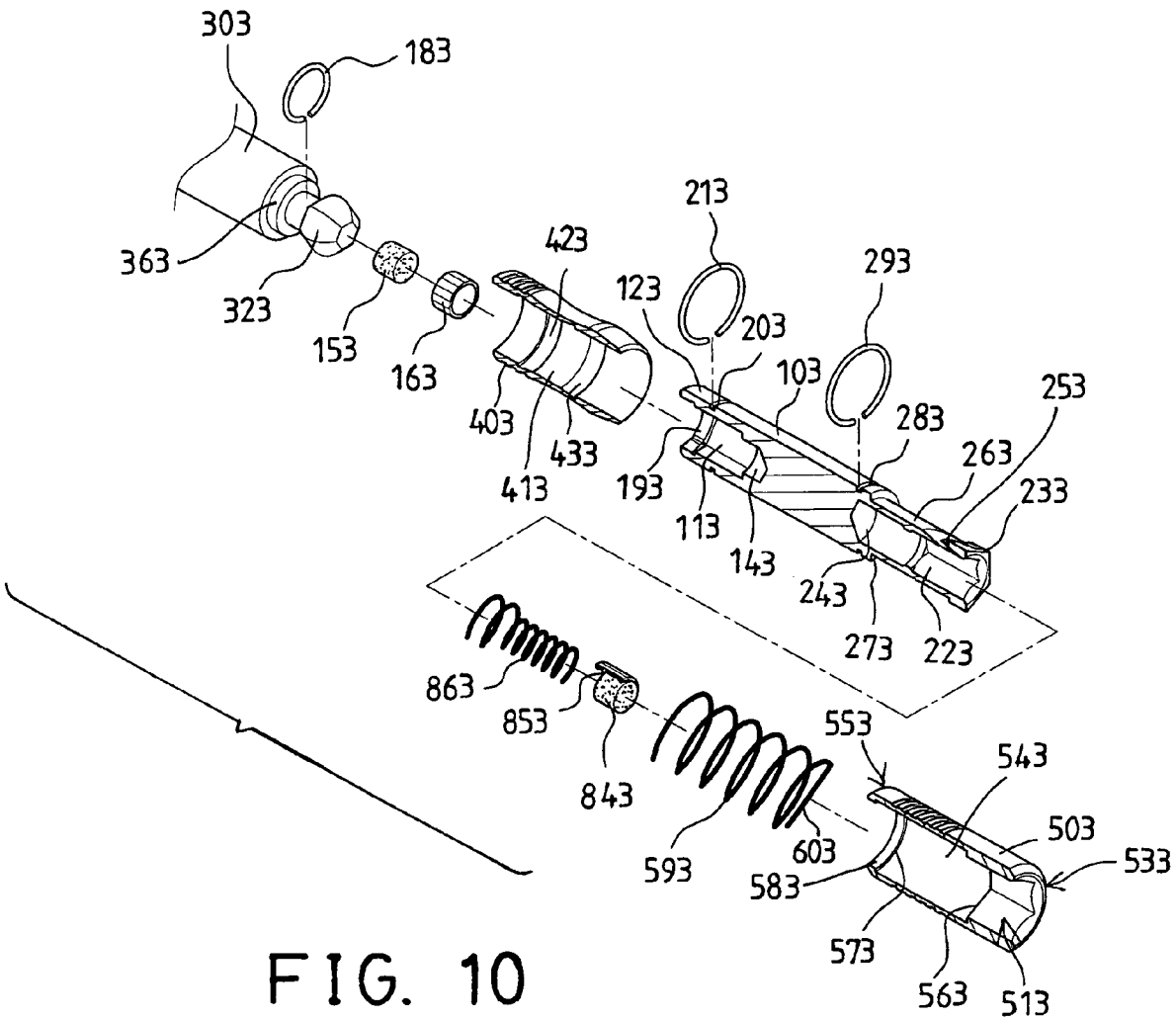
FIG. 10 is an exploded view similar to FIGS. 1 and 8, illustrating the still further arrangement of the tool device.
Figure 11:
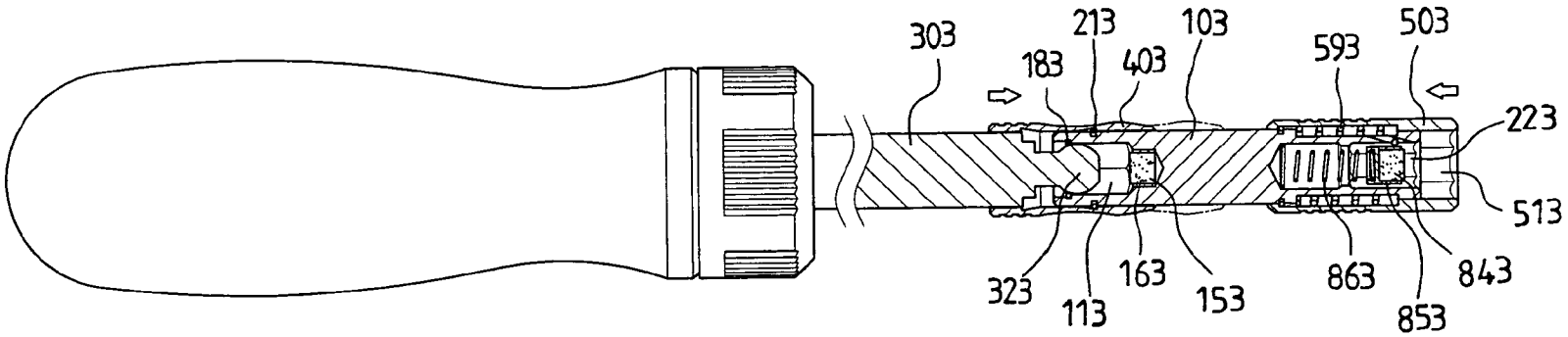
FIG. 11 is a plan schematic view of the tool device as shown in FIG. 10, in which a portion of the tool device has been cut off for showing an inner structure of the tool device as shown in FIG. 10.
Figure 12:
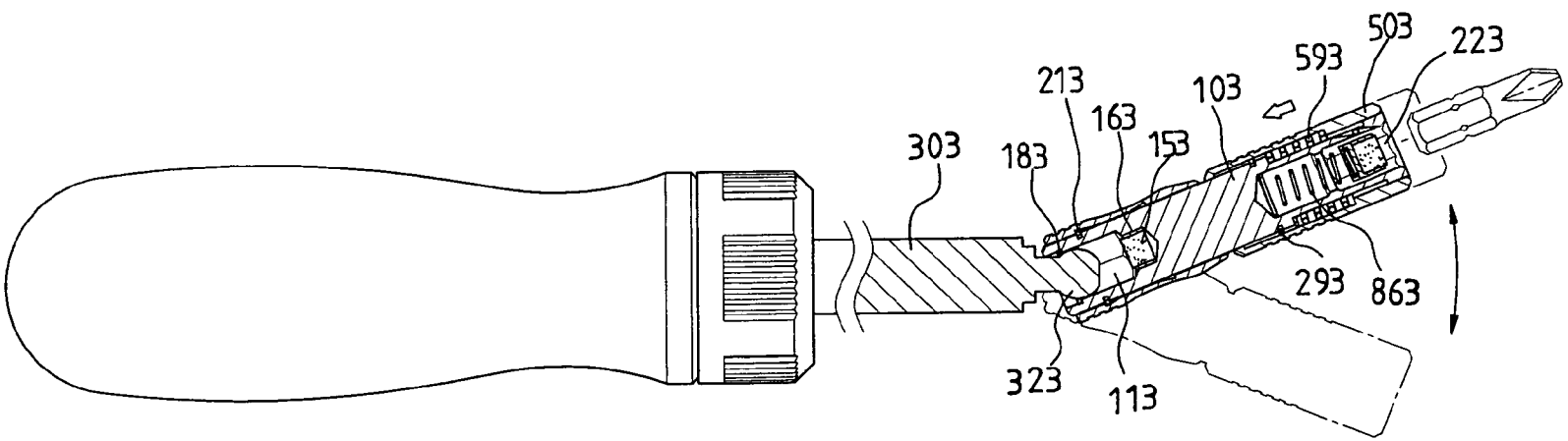
FIG. 12 is a plan schematic view similar to FIG. 11, illustrating the operation of the tool device.

Further alternatively, as shown in FIGS. 8 and 9, the shaft 102 also includes a socket opening 112 and a cavity 142 provided or formed in one end 122 thereof for slidably or rotatably or pivotally and tiltably or slantably receiving the rounded or spherical or engaging member 322 of the driving tool member 302, and includes a magnetic member 152 engaged into the cavity 142 of the shaft 102 with a barrel 162 for attracting the engaging member 322 of the tool member 302 toward the shaft 102, and includes a retaining member 182 engaged into the shaft 102 for selectively engaging with the engaging member 322 of the tool member 302 (FIG. 9) and for anchoring the engaging member 322 of the tool member 302 to the shaft 102, and includes an open end 192 for selectively engaging with or onto the peripheral protrusion 362 of the tool member 302 in order to anchor the engaging member 322 of the tool member 302 to the shaft 102 and to prevent the tool member 302 from being slanted or tilted relative to the shaft 102, and includes another retaining ring 212 engaged into a peripheral groove 202 of the shaft 102.

A control ferrule 402 is also slidably or rotatably attached or engaged onto the shaft 102 or includes a bore 412 for slidably receiving the shaft 102, and includes two peripheral and/or ratchet limiting grooves 422, 432 formed therein and communicating with the bore 412 of the control ferrule 402 for receiving or engaging with the retaining ring 212 and for limiting the control ferrule 402 to move or to slide relative to the shaft 102, and the shaft 102 includes a non-circular engaging hole 222 and a cavity 242 formed in the other end 232 thereof for receiving or engaging with various driven members (not shown), and includes a peripheral depression 262 formed in the inner peripheral portion thereof, and a smaller socket or sleeve 502 is slidably engaged into the engaging hole 222 of the shaft 102 or includes a bore 512 and a cavity 542 formed in one end 532 thereof for receiving or engaging with various driven members 832, a further retaining ring 582 is engaged onto the peripheral portion of the sleeve 502 and engaged in the peripheral depression 262 of the shaft 102 for limiting the sleeve 502 to slide relative to the shaft 102.

A magnetic member 842 may also be engaged into the cavity 542 of the sleeve 502 with a barrel 852 for attracting the driven members 832 toward the sleeve 502, and a spring member 592 is received in the engaging hole 222 of the shaft 102 and engaged with the sleeve 502 for biasing the sleeve 502 outwardly relative to the engaging hole 222 of the shaft 102 and for allowing the sleeve 502 to be selectively moved or engaged into the engaging hole 222 of the shaft 102 and thus for allowing the driven members 832 of different sizes or dimension or outer diameters to be selectively rotated or driven by the shaft 102 and the driving tool member 302 with the sleeve 502 or the shaft 102. It is to be noted that the shaft 102 may also be selectively slanted or tilted relative to the tool member 302 or in line with the tool member 302, and the sleeve 502 and the shaft 102 may also be used to selectively rotate or drive the driven members 832 of different sizes or dimension or outer diameters.

Further alternatively, as shown in FIGS. 10-15, the shaft 103 also includes a socket opening 113 and a cavity 143 provided or formed in one end 123 thereof for slidably or rotatably or pivotally and tiltably or slantably receiving the rounded or spherical or engaging member 323 of the driving tool member 303, and includes a magnetic member 153 engaged into the cavity 143 of the shaft 103 with a barrel 163 for attracting the engaging member 323 of the tool member 303 toward the shaft 103, and includes a retaining member 183 engaged into the shaft 103 for selectively engaging with the engaging member 323 of the tool member 303 (FIG. 12) and for anchoring the engaging member 323 of the tool member 303 to the shaft 103, and includes an open end 193 for selectively engaging with or onto the peripheral protrusion 363 of the tool member 303 in order to anchor the engaging member 323 of the tool member 303 to the shaft 103 and to prevent the tool member 303 from being slanted or tilted relative to the shaft 103, and includes another retaining ring 213 engaged into a peripheral groove 203 of the shaft 103.

Figure 13:
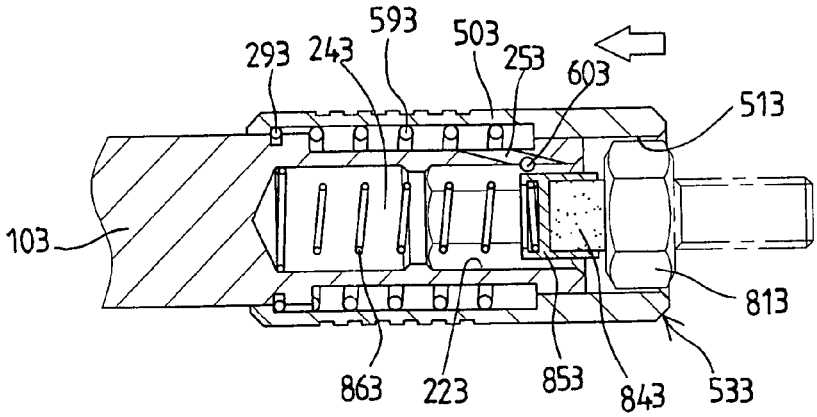
FIGS. 13, 14, 15 are enlarged partial cross sectional views illustrating the operation of the tool device as shown in FIGS. 10-12.
Figure 14:
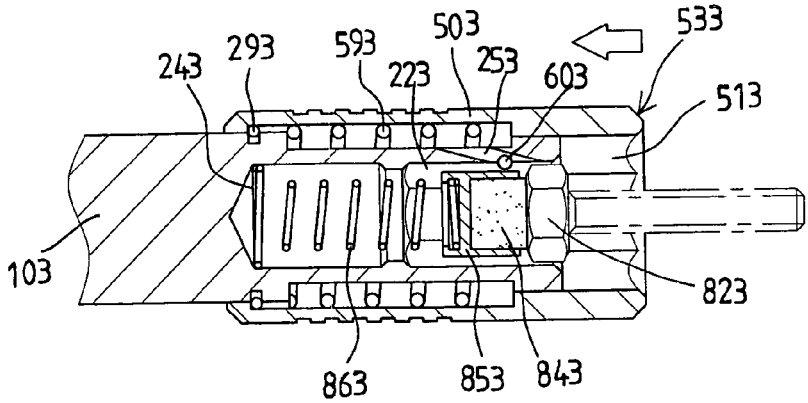

A control ferrule 403 is also slidably or rotatably attached or engaged onto the shaft 103 or includes a bore 413 for slidably receiving the shaft 103, and includes two peripheral and/or ratchet limiting grooves 423, 433 formed therein and communicating with the bore 413 of the control ferrule 403 for receiving or engaging with the retaining ring 213 and for limiting the control ferrule 403 to move or to slide relative to the shaft 103, and the shaft 103 includes a non-circular engaging hole 223 and a cavity 243 formed in the other end 233 thereof for receiving or engaging with various driven members 823, 833 (FIGS. 14-15), and includes a peripheral depression 263 formed in the outer peripheral portion thereof for forming an outer peripheral shoulder 273, and a sleeve 503 is slidably engaged onto the shaft 103 and includes a bore 513 formed in one end 533 thereof for receiving or engaging with various driven members 813 (FIG. 13).

The shaft 103 includes an outer peripheral slot 283 formed in the outer peripheral portion of the middle portion of the shaft 103 for receiving a retaining ring 293 therein which is partially extended out of the outer peripheral portion of the shaft 103. The sleeve 503 includes a peripheral depression 543 formed in the inner peripheral portion thereof and preferably located closer to the other end portion 553 thereof for forming or defining two inner peripheral shoulders 563, 573 and/or an outer peripheral flange 583 and for receiving a spring member 593, the spring member 593 may be engaged with the inner peripheral shoulder 563 of the sleeve 503 and the outer peripheral shoulder 273 of the shaft 103 for biasing the sleeve 503 to partially extend out of the other end 233 of the shaft 103 (FIGS. 13-15), or for biasing the other end 233 of the shaft 103 to selectively engage into the sleeve 503 and thus for allowing the driven members 813 to be engaged with the sleeve 503.

Figure 15:
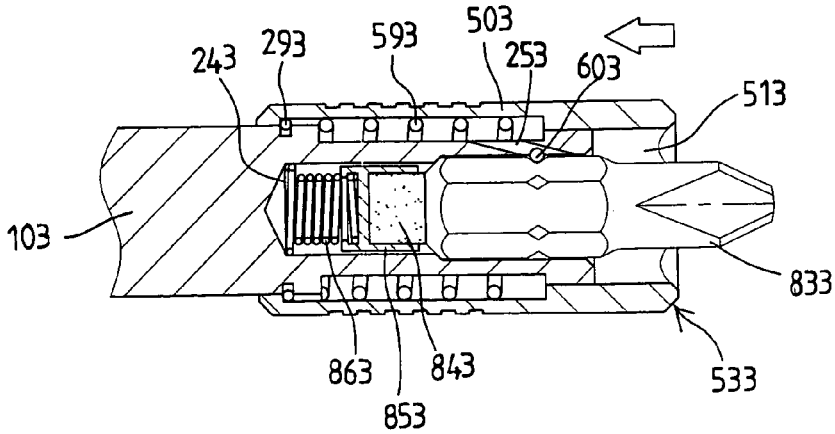

The other inner peripheral shoulder 573 or the outer peripheral flange 583 of the sleeve 503 may be selectively engaged with the retaining ring 293 for limiting the sleeve 503 to move or to slide relative to the shaft 103 and also for preventing the sleeve 503 from being disengaged from the shaft 103. A magnetic member 843 may be engaged into a barrel 853 which is slidably received in the cavity 543 of the sleeve 503 with for attracting the driven members 833 toward the sleeve 503, and another spring member 863 is also received in the engaging hole 223 or the cavity 243 of the shaft 103 and engaged with the barrel 853 for biasing the barrel 853 and the magnetic member 843 outwardly relative to the engaging hole 223 of the shaft 103 and for allowing the magnetic member 843 to be selectively forced or deeply engaged into the engaging hole 223 of the shaft 103 by the driven members 833 (FIG. 15).

It is also to be noted that the shaft 103 may also be selectively slanted or tilted relative to the tool member 303 or in line with the tool member 303, and the sleeve 503 and the shaft 103 may also be used to selectively rotate or drive the driven members 833 of different sizes or dimension or outer diameters. The shaft 103 may include an inclined passage 253 formed in the other end 233 of the shaft 103 and intersecting or communicating with the engaging hole 223 of the shaft 103, and the spring member 593 may include one end 603 engageable into the engaging hole 223 of the shaft 103 for engaging with the barrel 853 or the magnetic member 843 or the driven members 833 (FIG. 15) for preventing the barrel 853 or the magnetic member 843 or the driven members 833 from being disengaged from the shaft 103.

Figure 16:
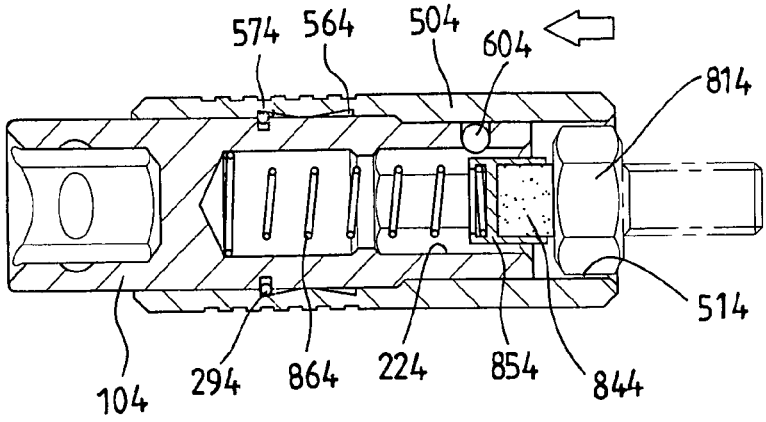
FIGS. 16, 17, 18 are enlarged partial cross sectional views similar to FIGS. 13-15 respectively illustrating the operation of the still further arrangement of the tool device.
Figure 17:
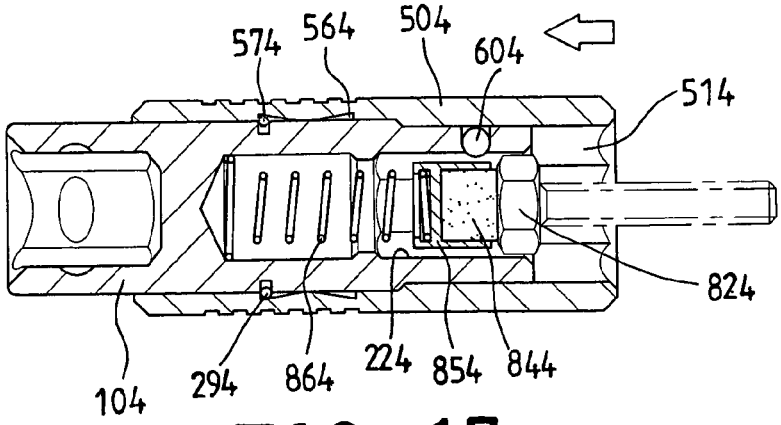
Figure 18:
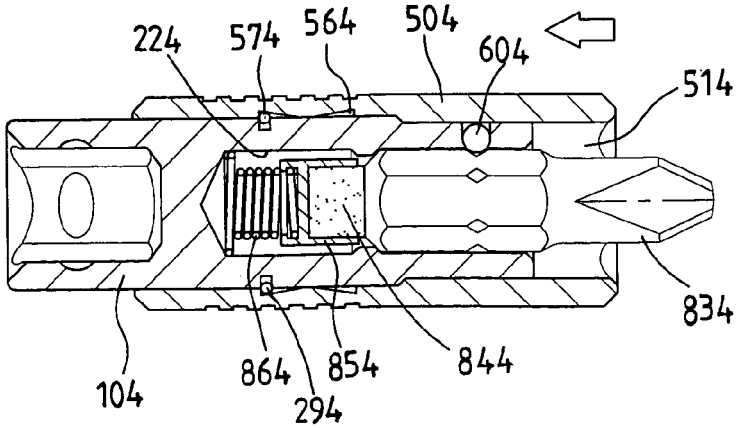

Further alternatively, as shown in FIGS. 16-18, the shaft 104 includes a non-circular engaging hole 224 formed in one end thereof for receiving or engaging with various driven members 824, 834 (FIGS. 17-18) and the spring member 864 and the barrel 854 and the magnetic member 844 for engaging with the driven members 814, 824, 834, and a sleeve 504 is slidably attached or engaged onto the shaft 104 or includes two peripheral and/or ratchet limiting grooves 564, 574 formed therein for engaging with the retaining ring 294 and for limiting the sleeve 504 to move or to slide relative to the shaft 104 and also for preventing the sleeve 504 from being disengaged from the shaft 104. A detent 604 is slidably attached or engaged into the shaft 104 and engageable into the shaft 104 for engaging with the driven members 834 (FIG. 18) and for preventing the driven members 834 from being disengaged from the shaft 104. The sleeve 504 includes a bore 514 for receiving or engaging with various driven members 814 (FIG. 16).

Accordingly, the tool device in accordance with the present invention includes a sleeve slidably attached onto a shaft for receiving and for driving various tool members of different sizes or diameters or dimensions.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool device comprising:

a tool member including a three-dimensional engaging member provided on a first end thereof and having at least one curved surface formed therein, a shaft including a first end having a non-circular socket opening formed therein and having at least one flat surface formed therein for pivotally receiving said engaging member of said tool member and for engaging with said at least one curved surface of said non-circular engaging member of said tool member and for allowing said tool member to be selectively tilted relative to a longitudinal axis of said shaft to different angular position, and said shaft including a second end having a non-circular engaging hole formed therein for receiving a first driven member, a control ferrule slidably engaged onto said shaft, and slidable and selectively engageable onto said tool member for retaining said longitudinal axis of said shaft in line with said tool member and for preventing said shaft from being tilted relative to said tool member to other angular position, a sleeve slidably attached to said second end of said shaft, and including a non-circular opening provided in a first end portion of said sleeve for selectively engaging with a second driven member, said sleeve being rotatable in concert with said shaft for allowing said first and said second driven member to be selectively driven by said shaft and said sleeve, and said sleeve including a peripheral flange formed therein, a spring member engaged between said shaft and said sleeve for biasing said sleeve relative to said shaft, and a retaining ring engaged onto said shaft and engageable with said peripheral flange of said sleeve for limiting said sleeve to slide relative to said shaft.

2. The driving tool as claimed in claim 1, wherein said shaft includes a retaining ring engaged onto said shaft and engageable with said control ferrule for limiting said control ferrule to slide relative to said shaft.

3. The driving tool as claimed in claim 2, wherein said control ferrule includes two limiting grooves formed therein for engaging with said retaining ring and for limiting said control ferrule to move relative to said shaft and for maintaining said control ferrule either in engagement with only said shaft or in engagement with both said shaft and said tool member.

4. The driving tool as claimed in claim 1, wherein said tool member includes a peripheral depression formed therein and arranged for allowing said shaft to be tilted relative to said tool member to different angular position.

5. The driving tool as claimed in claim 4, wherein said shaft includes a retaining member disposed therein for selectively engaging with said engaging member and said peripheral depression of said tool member and for preventing said engaging member of said tool member from being disengaged from said shaft.

6. The driving tool as claimed in claim 1, wherein said shaft includes a magnetic member disposed therein for attracting said engaging member of said tool member to said shaft.

7. The tool device as claimed in claim 1, wherein said shaft includes a magnetic member disposed therein for attracting said first driven member to said shaft.

8. The tool device as claimed in claim 1, wherein said shaft includes a non-circular segment formed on an outer peripheral portion of said second end of said shaft for engaging with said non-circular opening of and said sleeve and for allowing said sleeve to be rotatable in concert with said shaft.

9. The tool device as claimed in claim 1, wherein said sleeve includes an inner peripheral depression formed therein for receiving said spring member.

* * * * *